United States Patent [19]

Babb, Jr. et al.

[11] Patent Number: 4,550,939

[45] Date of Patent: Nov. 5, 1985

[54] SECURITY STRIKE ASSEMBLY

[75] Inventors: John H. Babb, Jr., Grand Rapids, Mich.; Robert A. Marotto, Auburn, Ala.

[73] Assignee: Kysor Industrial Corporation, Cadillac, Mich.

[21] Appl. No.: 503,819

[22] Filed: Jun. 13, 1983

[51] Int. Cl.[4] ..... E05C 21/02

[52] U.S. Cl. ..... 292/340

[58] Field of Search ..... 292/340, 346, 337, 357; 70/450–452, 416, 417; 411/383, 531, 546, 366–368

[56] References Cited

U.S. PATENT DOCUMENTS

| | | | |
|---|---|---|---|
| 756,447 | 4/1904 | Von Wobeser | 70/452 |
| 2,499,315 | 2/1950 | Johnson | 411/367 X |
| 3,055,690 | 9/1962 | Benson | 292/337 X |
| 3,095,021 | 6/1963 | Schlage et al. | 292/340 X |
| 3,290,081 | 12/1966 | Sushan | 292/346 |
| 3,550,412 | 12/1970 | Pitel et al. | 70/451 X |
| 3,835,615 | 9/1974 | King, Jr. | 411/368 X |
| 4,186,954 | 2/1980 | Detlefs | 292/340 |
| 4,296,619 | 10/1981 | Widen | 70/452 X |

*Primary Examiner*—Richard E. Moore

*Attorney, Agent, or Firm*—Price, Heneveld, Huizenga & Cooper

[57] ABSTRACT

A security strike plate assembly comprises a strike plate that is mounted directly on the door framing by rigid bushings and mating screws. Holes are drilled through the door jamb and into the door framing a predetermined distance to form shoulders at the bottoms of the holes. The rigid bushings are closely received in the holes, and extend from the shoulders to the interior surface of the strike plate. The screws extend through mating apertures in the strike plate and the central apertures of the bushings, and into the door framing, such that selected forces applied to the strike plate are transmitted to and resisted by the door.

8 Claims, 6 Drawing Figures

SECURITY STRIKE ASSEMBLY

BACKGROUND OF THE INVENTION

This invention relates to door lock apparatus, and particularly to the mounting of the door strike for a deadbolt security lock.

The door frame and jamb assemblies of residential dwellings and some commerical buildings are typically constructed of wood, often soft wood such as pine. Such assemblies have proven to be susceptible to unauthorized entry by component failure of the jamb/strike components. Such failure is defined in the ANSI/ASTM F476-76 TEST STANDARD as a pull-out or fracture of the strike attachment screws or any splitting, bending, or fracture of the door jamb at the strike that permits the door to be opened. Typically a metal strike plate is mounted with screws to the jamb portion of the door frame. This strike plate receives the deadbolt when the latter is thrown to the extended lock position. Because such strike plates are typically attached with only two screws, while the door hinges on the opposite edge of the door are mounted with at least six to nine screws, this edge of the door frame on which the lock is mounted is the weaker side. In the typical installation, if an intruder applies a moderate amount of force to such hardward, as with a pry bar, cracks propagate in the wood door frame and/or jamb, and/or the screws bend, any or all of which allow such screws to fall out, to release the door.

This problem is compounded by the fact that the door frame itself may be constructed from relatively thin wood which is inserted into support framing and nailed thereto. This design creates two additional problems. First, there is usually a space left between the support framing and the door frame. When screws are inserted through the door frame therefor, they must extend through this open space before hopefully engaging support framing. Sometimes they do not reach the support framing. Second, even if the screws are long enough to reach the support framing, the space left between the door frame and the support framing creates the possibility that the door frame can be split and the screws readily bent when an intruder applies prying force to the locked door. In this latter situation, the screws can bend even while their inner ends are firmly screwed into the support framing, permitting an intruder to obtain entry into the locked dwelling. Therefore, there is a need for door strike devices which can more effectively secure door security hardware.

SUMMARY OF THE INVENTION

The present invention effects a security strike assembly which passes the highest level of performance under the ANSI/ASTM F476-76 test designated 21.3 Bolt Impact Test. The door remains secure, and moreover, the lock hardware remains operational. Yet, this significant improvement is achieved with relatively simple components. Specifically, long steel screws surrounded by cylindrical steel bushings or collars extend through the strike plate, through the door frame, and into the building frame, specifically the building frame support studs to which the door frame is attached. The invention is effective even for door frames made of soft wood. The screw holes are preferably laterally offset to lessen potential for splitting of the jamb. Having very briefly described the various objects and advantages of the present invention, reference is now made to the drawings.

DESCRIPTION OF THE PREFERRED EMBODIMENT

Figure 1:
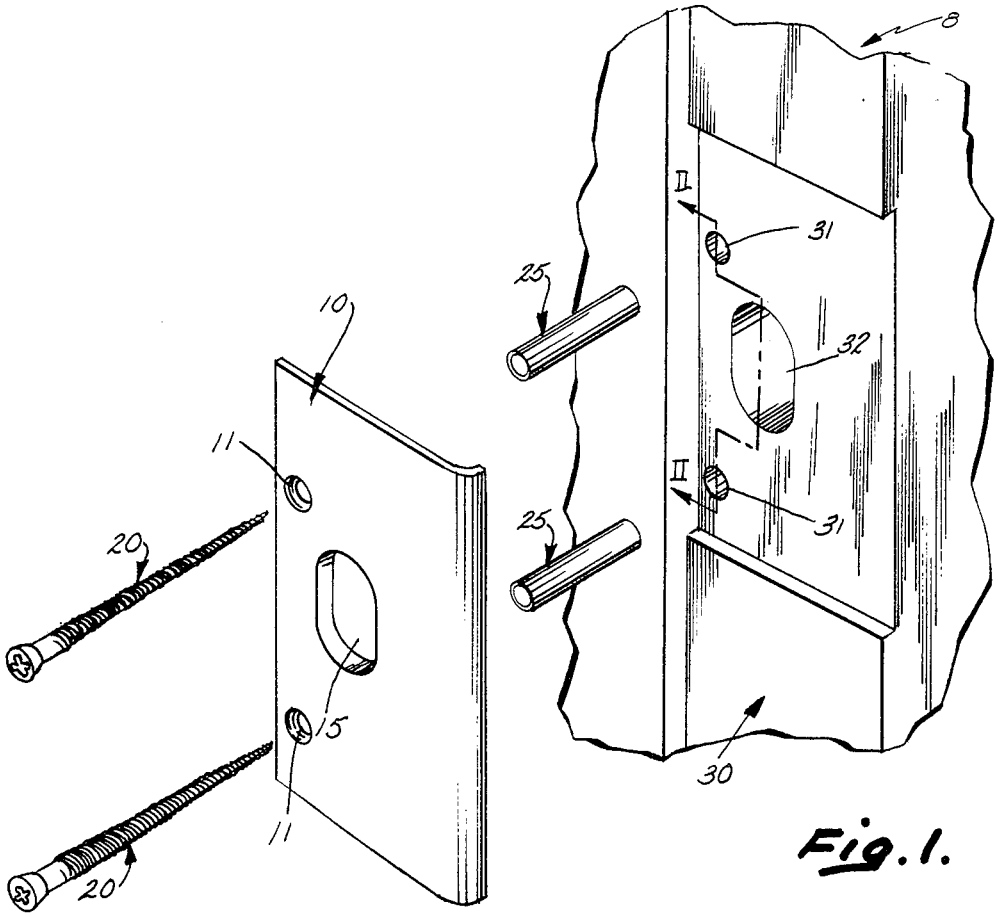
FIG. 1 is a partial perspective exploded front view of a door frame and the various components of the security strike plate of the present invention.
Figure 2:
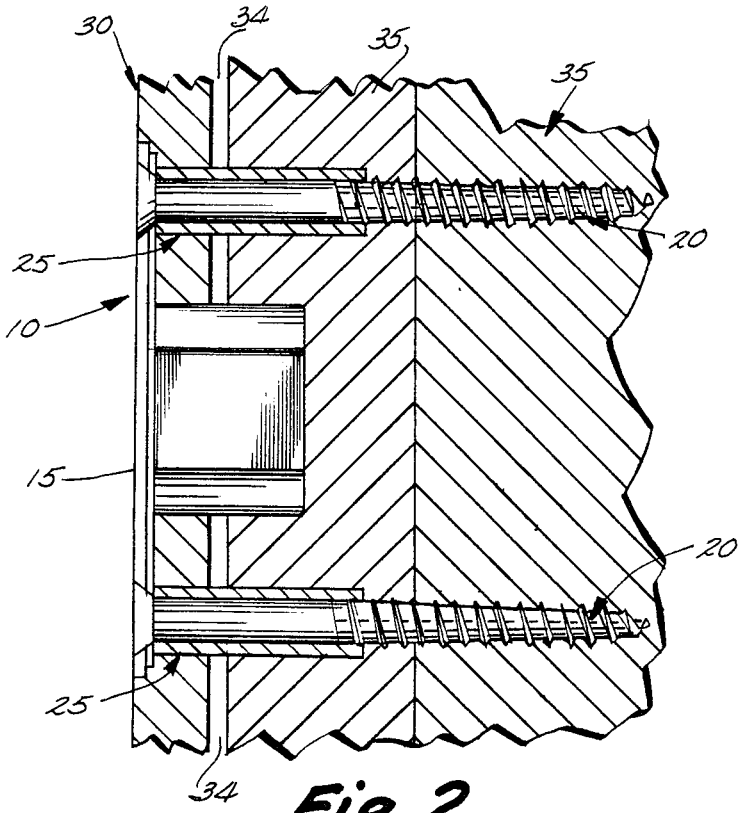
FIG. 2 is a partial cross-sectional, side elevational view showing this invention mounted on a door frame and anchored into support framing behind the door frame.
Figure 3:
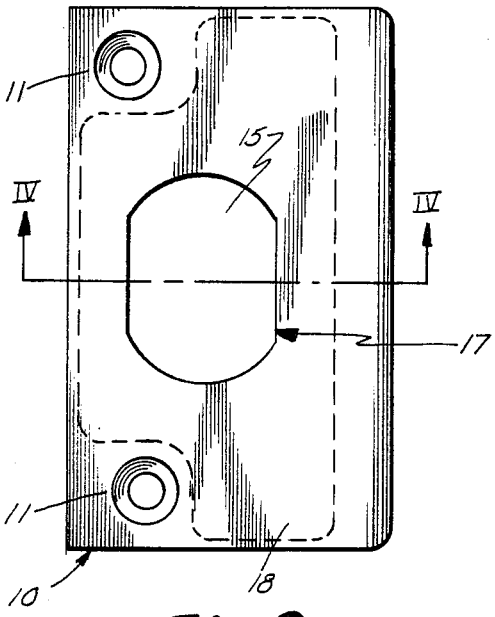
FIG. 3 is a front elevational view of the strike plate of the present invention illustrating the arrangement of the screw holes in relation to the bolt hole and showing the strike box assembly in shadow.
Figure 5:
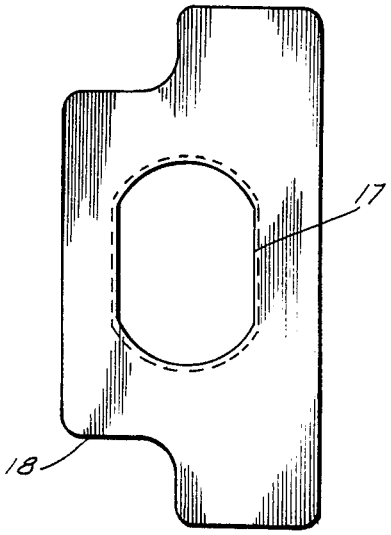
FIG. 5 is a front elevational view of the strike box assembly.
Figure 4:
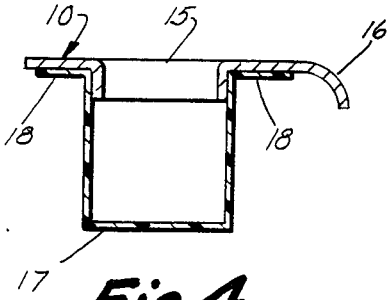
FIG. 4 is a cross-sectional view taken along the plane IV—IV of FIG. 3.
Figure 6:
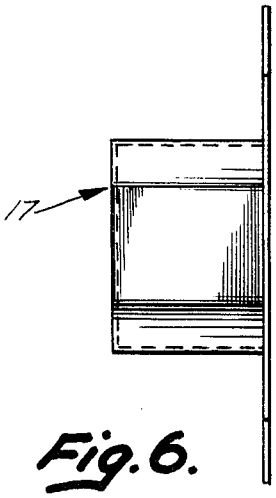
FIG. 6 is a side elevational view of the strike box assembly.

Referring to FIG. 1, the assembly 8 is depicted in exploded fashion including the jamb of the door frame 30, strike plate 10, elongated screws 20, and metal bushings 25. Bushings 25 are inserted into holes 31 in door frame 30. Holes 31 correspond with holes 11 on strike plate 10 so that when strike plate 10 is mounted on door frame 30, screws 20 can be inserted through holes 11 and through bushings 25 in holes 31. Holes 31 extend beyond door frame 30 into support framing 35, which is normally a double stud, as shown in FIG. 2. In the preferred embodiment, bushings 25 are approximately 1.5 inches long and the screws approximately 3.25 inches long. In most applications, a bushing of this length will be sufficient to extend through door frame 30 and space 34 and into support framing 35. However, longer bushings may be employed if an especially thick door frame 30 or wide space 34 is encountered. Bushings 25 should be sufficiently short so as not to cover a substantial portion of the threads of screw 20 to interfere with the anchoring function of screws 20. Bushings 25 should not be so long as to extend completely through support framing 35 since this would prevent screws 20 from being anchored in support framing 35.

The length of the screw is somewhat dictated by the length of bushing 25. Screws 20 should be sufficiently long that they extend substantially beyond bushings 25 into support framing 35.

In the preferred embodiment, strike plate 10 has a lip 16 which adds strength to the strike plate. Lip 16 also protects door frame 30 from being hit by an extended deadbolt in locked condition on a closing door. Holes 11 and 15 on strike plate 10 and corresponding holes 31 and 32 on door frame 30 are preferably laterally offset from each other, i.e. situated such that the centers of holes 11 and 15 do not form a straight vertical line parallel to door frame 30. Furthermore, each of holes 11 and corresponding holes 32 should be offset from each other (i.e. situated such that their centers do not form a straight vertical lie parallel to door frame 30). By so doing, more force is required to split wood door frame 30 and support framing 35.

FIGS. 3–6 illustrate a strike box assembly which may also be used with the present invention. This assembly consists of box 17 and flange 18, and performs two functions. First, it serves as a depth gage to insure that a sufficient amount of wood is removed by the installer to allow the deadbolt to fully project to the extended, deadlocked position. Second, it performs a cosmetic function, concealing rough edges of hole 32. Flange 18 adds support to box 17.

Strike plate 10, screws 20, and bushings 25 are manufactured of metal, usually steel. Strike box 17 can be molded from plastic; however, said box could be stamped of sheet metal. Tests conducted by the applicant have established that this invention passes grade 40 requirements of ANSI/ASTM F476-76 "Standard Test Methods for Security of Swinging Door Assemblies". Grade 40 is the highest grade established by ASTM for security of swinging door assemblies. It involves two blows of 59 foot-pound force applied to the door, plus two additional blows of 89 foot-pound force, plus two blows of 118 foot-pound force, and finally two blows of 148 foot-pound force. When this was performed on a door utilizing the present invention, the security of the door was not violated, but remained intact, and moreover, the hardware remained operational.

The above is the preferred embodiment of the invention. Various minor changes and alterations may be made without departing from the spirit of this invention, which is to be limited only by the attached claims and the reasonable equivalents thereto.

The embodiments of the invention in which an exclusive property or privilege is claimed are defined as follows:

1. A forced entry inhibiting strike plate assembly in combination with a door jamb and door support framing comprising:

a strike plate having an enlarged opening to receive a lock bolt, and smaller openings to receive fastener screws;

elongated fastener screws for mounting said strike plate;

mounting apertures extending into said framing a predetermined distance to form shoulders at the bottoms of said mounting apertures;

elongated rigid bushings extending from said strike plate through the door jamb, and being closely received in the mounting apertures in said door support framing, with the ends of said bushings abutting the shoulders of said mounting apertures;

and said screws extending through said bushings and threaded into said door support framing.

2. The strike plate assembly in claim 1 wherein said elongated screws are at least about $3\frac{1}{4}$ inches long and said bushings are at least about $1\frac{1}{2}$ inches long, and said smaller openings are laterally offset to avoid lying on a directly vertical line.

3. A method of mounting a door lock strike plate assembly on a door jamb secured to door frame studs, comprising the steps of:

providing a strike plate having an enlarged opening for receiving a lock bolt, and smaller openings to receive fastener screws;

drilling holes through said door jamb and into said door frame studs a predetermined distance to form shoulders at the bottoms of the holes;

inserting cylindrical rigid bushings into said holes to extend through said door jamb and into said door frame studs, with the ends of said bushings closely received in the holes and abutting said shoulders and extending substantially to said strike plate;

inserting elongated screws through said strike plate smaller openings and through said bushings;

and threadably fastening said screws into said door frame studs until strike plate is tight against said door jamb.

4. A strike plate assembly in combination with door support framing, comprising:

a strike plate having means for selectively engaging a lock bolt, and at least one fastener aperture therethrough;

at least one mounting recess extending into said framing a predetermined distance to form a shoulder at the bottom of said mounting recess;

at least one elongated, rigid bushing with a central aperture therethrough; said bushing extending from said strike plate and being closely received in said mounting recess, with the end of said bushing abutting the shoulder of said mouting recess;

at least one elongated, rigid screw having a length substantially longer than said bushing, and extending through the fastener aperture in said strike plate and the central aperture of said bushing, and threadedly into said framing, whereby selected forces applied to said strike plate are transmitted to and resisted by said framing.

5. A strike plate assembly for installation on a door jamb having an orifice therethrough, and associated door support framing having a recess with a bottom shoulder, said assembly comprising:

a strike plate having means for selectively engaging a lock bolt, and at least one fastener aperture therethrough;

at least one elongated, rigid bushing having an annularly shaped body with opposite ends, and a central aperture therethrough; said bushing being coaxially aligned with said fastener aperture, and having one end thereof abutting an interior face of said strike plate, and the other end thereof shaped to extend through the door jamb orifice, and for close reception in the recess in the framing and abutment with the shoulder formed at the bottom of the recess;

at least one elongated, rigid screw having a length substantially longer than said bushing, and extending through the fastener aperture in said strike plate and through the central aperture of said bushing to protrude therebeyond for threaded engagement into the framing, such that during operation selected forces applied to said strike plate are transmitted to and resisted by the framing.

6. A strike plate assembly as set forth in claim 5, wherein said strike plate lock bolt engaging means comprises:

a lock bolt aperture extending through a central portion of said strike plate, and shaped to closely receive a lock bolt therethrough; and a thin-walled strike box attached to the interior face of said strike plate, and covering said lock bolt aperture.

7. A strike plate assembly as described in claim 6, wherein:

said strike box is constructed of molded plastic, and is adhered to the interior face of said strike plate.

8. A strike plate assembly as described in claim 7, wherein:

said strike plate includes a second fastener aperture therethrough; said fastener apertures being positioned on opposite sides of said lock bolt aperture; and including a second elongated, rigid bushing having an annularly shaped body with opposite ends, and a central aperture therethrough; said second bushing being coaxially aligned with said second fastener aperture, and having one end thereof abutting the interior face of said strike plate, and the other end thereof shaped to extend through a second door jamb orifice, and for close reception in a second recess in the framing and abutment with a second shoulder formed at the bottom of the second recess;

a second elongated, rigid screw having a length substantially longer than said second bushing, and extending through the second fastener aperture in said strike plate and through the central aperture of said second bushing to protrude therebeyond for threaded engagement into the framing.

* * * * *